US011774214B2

(12) United States Patent
Bernaz et al.

(10) Patent No.: US 11,774,214 B2
(45) Date of Patent: Oct. 3, 2023

(54) ACCESSORY RETAINING STRAP

(71) Applicants: Michael R. Bernaz, Hazlet, NJ (US); Joseph Fasanella, Staten Island, NY (US)

(72) Inventors: Michael R. Bernaz, Hazlet, NJ (US); Joseph Fasanella, Staten Island, NY (US)

( * ) Notice: Subject to any disclaimer, the term of this patent is extended or adjusted under 35 U.S.C. 154(b) by 201 days.

(21) Appl. No.: 17/249,636

(22) Filed: Mar. 8, 2021

(65) Prior Publication Data

US 2021/0278170 A1 Sep. 9, 2021

Related U.S. Application Data

(60) Provisional application No. 62/986,280, filed on Mar. 6, 2020.

(51) Int. Cl.
*F41C 33/04* (2006.01)

(52) U.S. Cl.
CPC ..... *F41C 33/04* (2013.01)

(58) Field of Classification Search
CPC ..... F41C 33/04
USPC ..... 224/267, 219–222, 901.4
See application file for complete search history.

(56) References Cited

U.S. PATENT DOCUMENTS 3,543,977 A * 12/1970 Lockridge ..... A45F 5/00 248/444
4,088,136 A * 5/1978 Hasslinger ..... A61M 25/02 604/179
4,096,863 A * 6/1978 Kaplan ..... A61M 25/02 604/179
4,579,265 A * 4/1986 Schiller ..... A45C 1/04 224/587
4,966,320 A 10/1990 DeSantis et al.
4,991,234 A * 2/1991 Greenberg ..... A61F 5/028 2/920
5,104,076 A * 4/1992 Goodall, Jr. ..... A45F 5/14 248/205.2
5,214,874 A * 6/1993 Faulkner ..... A01K 87/00 24/442
5,236,113 A 8/1993 Wisser
5,294,031 A 3/1994 Volpei et al.
5,433,359 A * 7/1995 Flowers ..... A45F 5/00 224/267
5,465,889 A 11/1995 Smith
5,505,355 A 4/1996 Williams
5,533,657 A 7/1996 Rosen et al.
D403,296 S * 12/1998 Thomas ..... D12/417
6,076,715 A 6/2000 Easter
6,691,906 B2 2/2004 Cragg
(Continued)

*Primary Examiner* — Justin M Larson
(74) *Attorney, Agent, or Firm* — Dunlap Bennett & Ludwig, PLLC

(57) ABSTRACT

An accessory retaining strap for securing an accessory item to an item associated with the accessory. The strap may be formed with a first element joinable to a first element, at an intermediate portion thereof to define a three-band strap. Two bands are cooperatively joined by a Velcro® to secure the strap about the item, while an elastically extensible band is wrapped about the accessory item and cooperatively joined to the retaining strap. Embodiments of the accessory retaining strap is configured to retain the accessory to a firearm, or firearm carrier, such as a holster.

11 Claims, 3 Drawing Sheets

(56) References Cited

U.S. PATENT DOCUMENTS

| | | | | |
|---|---|---|---|---|
| 7,441,946 | B2 * | 10/2008 | Bonadei | A44B 11/24 224/267 |
| 7,651,219 | B2 * | 1/2010 | Burlingham | G02C 3/04 351/158 |
| 8,328,058 | B2 | 12/2012 | Wilson | |
| 8,393,504 | B2 * | 3/2013 | Scott | F42B 39/02 224/150 |
| 10,016,050 | B2 | 7/2018 | Dent | |
| 10,016,052 | B2 | 7/2018 | McStay | |
| 10,030,934 | B2 | 7/2018 | Metayer | |
| 10,143,594 | B2 * | 12/2018 | Jackson | A61F 13/00017 |
| 10,352,651 | B1 | 7/2019 | Vredenburg | |
| 10,415,928 | B2 | 9/2019 | Jwszenski | |
| 10,982,929 | B2 * | 4/2021 | Rodriguez | F41C 33/002 |
| 11,408,557 | B2 * | 8/2022 | Wong | A45F 5/00 |
| 2008/0185414 | A1 | 8/2008 | Conlon | |
| 2009/0314813 | A1 | 12/2009 | Woolery | |
| 2011/0168747 | A1 * | 7/2011 | Scott | F41C 33/002 224/150 |
| 2011/0290835 | A1 * | 12/2011 | Bartet | A45F 5/00 224/267 |
| 2014/0027479 | A1 | 1/2014 | Hogue | |
| 2016/0124289 | A1 * | 5/2016 | James | A45F 3/00 224/267 |
| 2021/0278170 | A1 * | 9/2021 | Bernaz | F41C 33/04 |

* cited by examiner

ACCESSORY RETAINING STRAP

CROSS-REFERENCE TO RELATED APPLICATION

This application claims the benefit of priority of U.S. provisional application No. 62/986,280 filed Mar. 6, 2020, the contents of which are herein incorporated by reference.

BACKGROUND OF THE INVENTION

The present invention relates to straps, and more particularly to straps for retaining an accessory to an item to which the accessory is related.

For law enforcement, military personnel, and firearms owners, it is often desirable to carry an accessory on a holster so that the accessory item is immediately available when needed. The accessory may include a variety of items such as an, a radio or component thereof, an illumination device, or an emergency medical item, such as a tourniquet.

While various tactical equipment carriage systems, such as belts, vests, and harnesses are provided for many tactical items, there are certain items that the user may want to have readily available without reliance on a tactical equipment carriage system, or in circumstances or situations where the wear of a tactical equipment carriage system may not be desirable. Also a user may need to have additional belt space which allow items to be worn or carried on other locations besides the belt.

As an alternative, carriers have been devised for holsters or for attachment of the tactical or medical accessories. Due to their design, these carriers are often found limited application in that they are designed for a specific type of holster, gunstock, or the like. Few of these carriers offer universal adaptability for attachment of an accessory to the item to which the accessory relates. Those that do, are typically of a pouch configuration or have a retaining loop(s) that also limit the size or type of accessory carried.

As can be seen, there is a need for an improved accessory retaining strap.

SUMMARY OF THE INVENTION

In one aspect of the present invention, a retaining strap for securing an accessory item to a firearm, is disclosed. The retaining strap includes a first element formed as a strap having an inner surface, an outer surface, and an attachment end. The first element having a length dimensioned to retain the accessory item with the retaining strap. A second element formed as an elongate strap having a proximal end, a distal end, a top surface and a bottom surface. The second element having a length dimensioned to extend around at least one of a portion of a firearm, or a carrier for the firearm. A first cooperating fastener material and a second cooperating fastener material configured for releasable engagement. The first cooperating fastener material covers the inner surface of the attachment end and at least a portion of the bottom surface of the second element. The second cooperating fastener material covers at least the proximal end and the distal end of the second element on the top surface thereof. An elastic web interconnects the first element at an attachment point located at an intermediate position of the top surface of the second element.

In other aspects of the invention, a method of releasably securing an accessory item to a firearm or a carrier for the firearm is disclosed. The method includes providing a retaining strap comprising a first strap having an inner surface, an outer surface, an attachment end, and an elastic web, the first strap having a length dimensioned to retain the accessory item with the retaining strap; an elongate web having a proximal end, a distal end, a top surface and a bottom surface, the elongate web having a length dimensioned to extend around at least one of a portion of the firearm, or the carrier for the firearm, the elastic web attached to the elongate web at an attachment point positioned intermediate portion of the elongate web, to define a second and a third strap from the elongate web at each of the proximal end and the distal end of the elongate web, a first cooperating fastener material and a second cooperating fastener material configured for releasable engagement; the first cooperating fastener material covering the inner surface of the attachment end and at least a portion of the bottom surface of the elongate web, the second cooperating fastener material covering at least the proximal end and the distal end of the elongate web on the top surface thereof. The second strap and third strap are wrapped about one of the firearm or the carrier for the firearm. The second strap is secured to the third strap by cooperative engagement of the first cooperating fastener material on the bottom surface of the elongate web with the second cooperating fastener material on the top surface of the elongate web. These and other features, aspects and advantages of the present invention will become better understood with reference to the following drawings, description and claims.

DETAILED DESCRIPTION

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provides a system, method, and apparatus for retaining an accessory to an item, such as a firearm. In the non-limiting embodiment shown, the accessory retaining strap 10 is described in the context of retaining an accessory for a medical device like tourniquet. The unique features of the present invention allow for universal adaptability to a variety of medical and tactical accessories and firearms.

Figure 1:
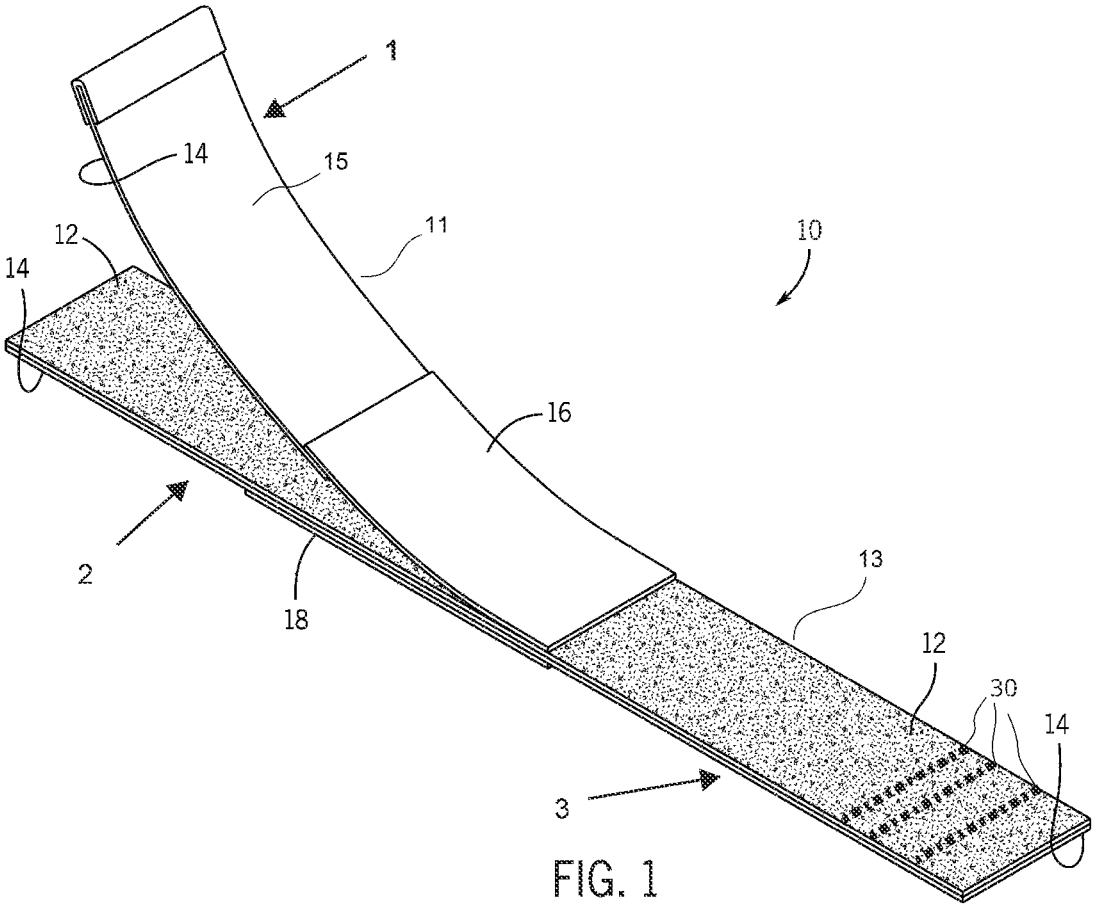
FIG. 1 is a top front perspective view of the accessory retaining strap.
Figure 2:
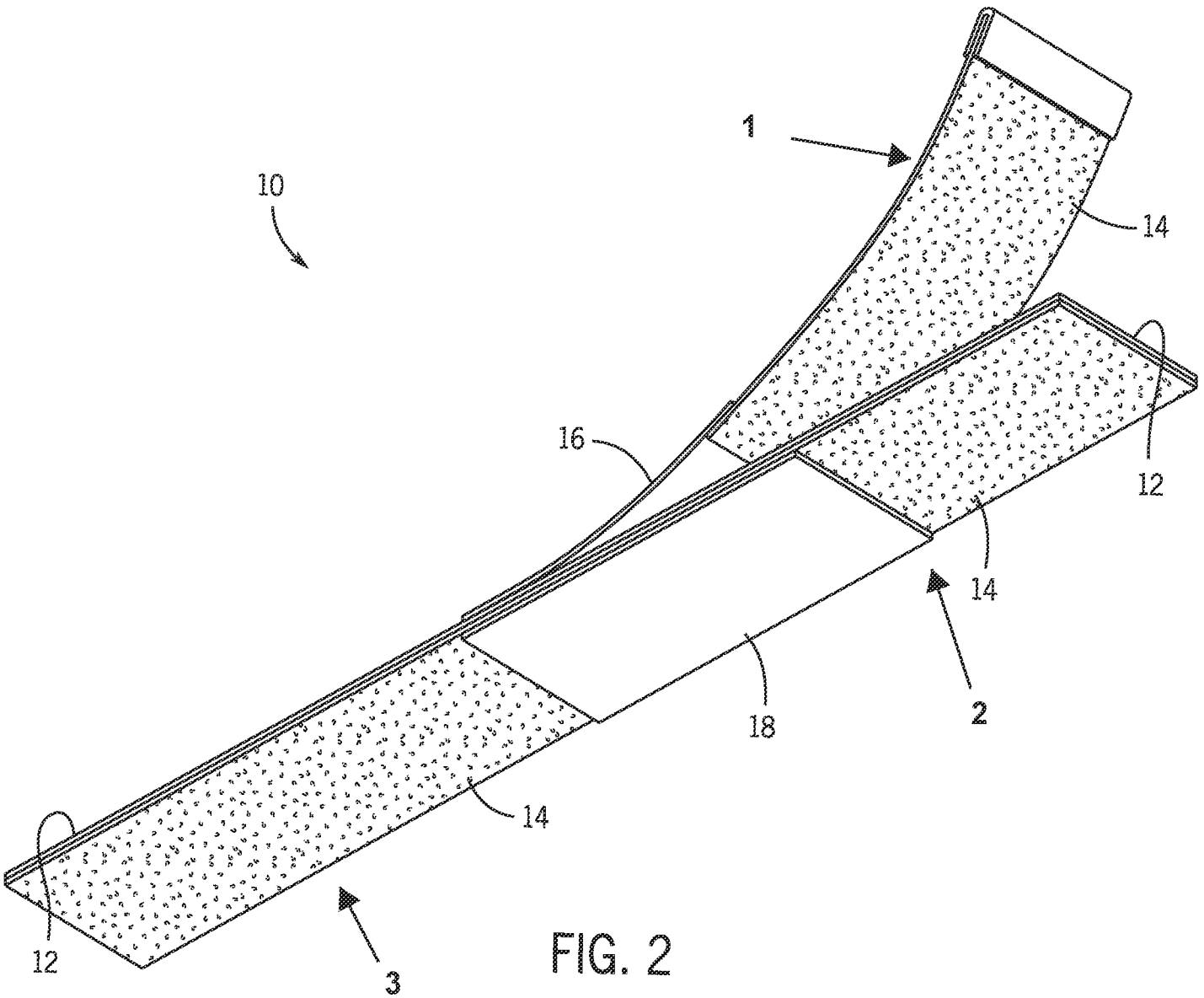
FIG. 2 is a bottom rear perspective view of the accessory retaining strap.
Figure 3:
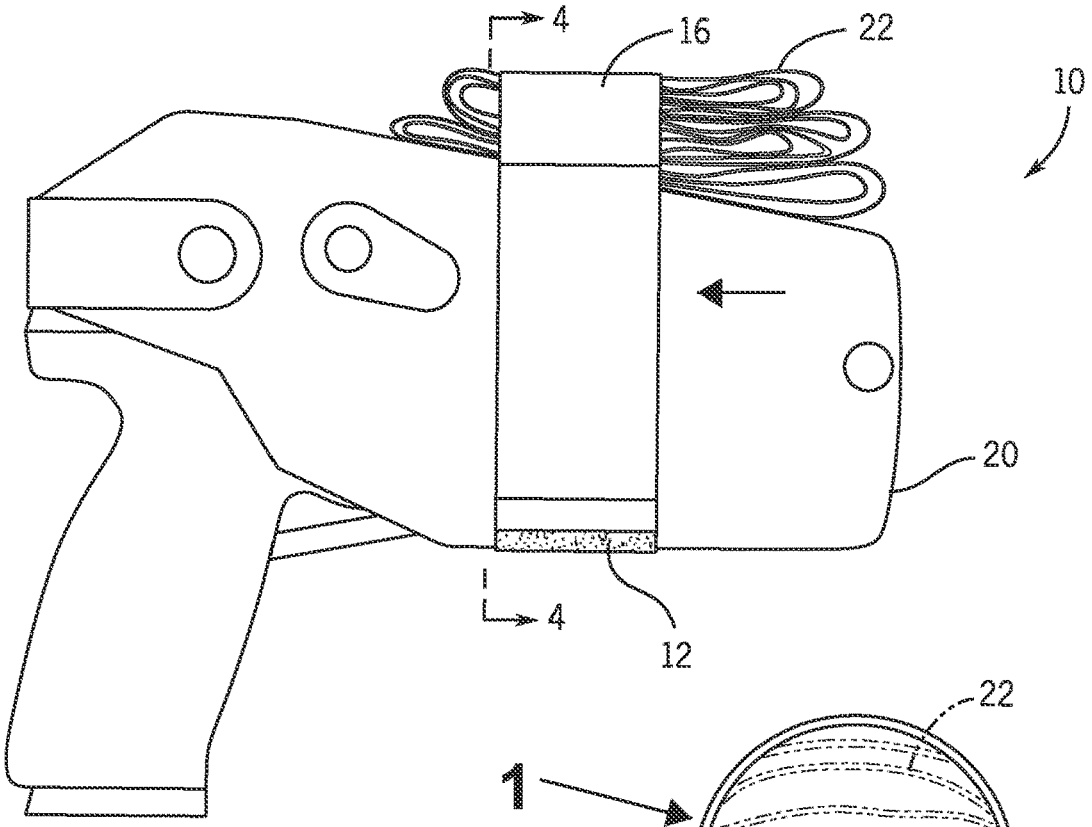
FIG. 3 is a side elevation view of the accessory retaining strap in use retaining a tourniquet to a handgun.
Figure 4:
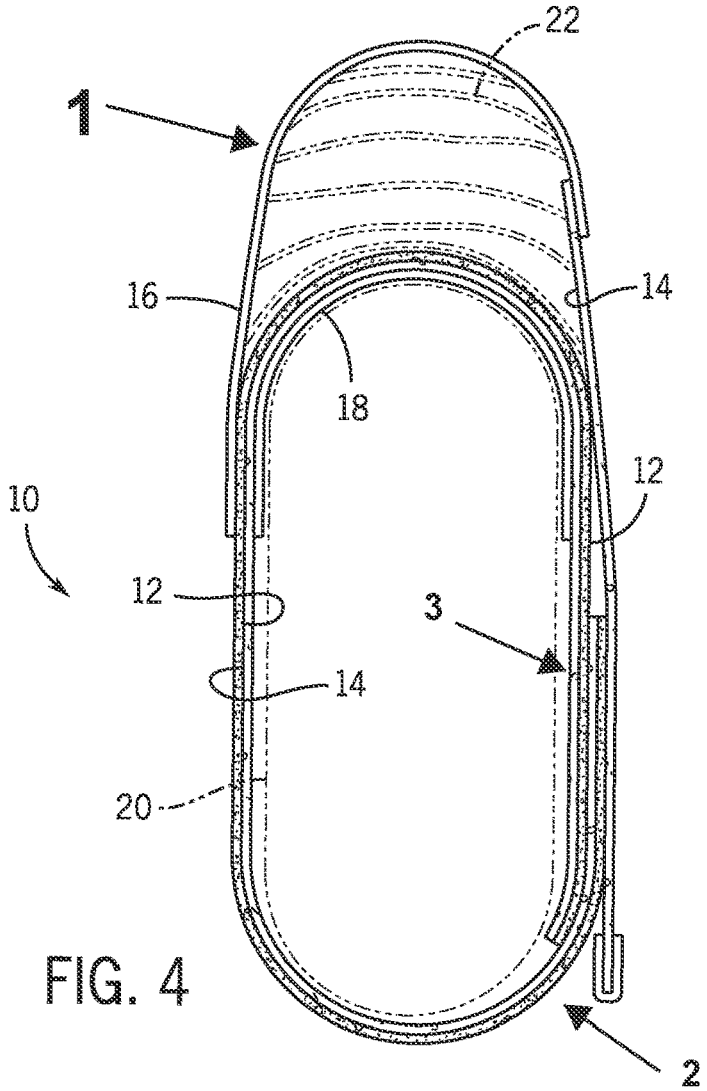
FIG. 4 is a section view of the accessory retaining strap taken along line 4-4 of FIG. 3.

As seen in reference to the drawings and photographs of FIGS. 1-4, the accessory retaining strap 10 according to aspects of the invention are shown in which a first element 11 and a second element 13 are joinable to form a three band strap. The first element 11 is configured for securement of the accessory 22 to the accessory retaining strap 10. The first element 11 is joined to the second element 13. The second element 13 is configured to retain the accessory retaining strap 10 to a firearm 20, or firearm carrier, such as a holster 20.

In the non-limiting embodiment shown, the first element 11 includes a strap having an attachment end 15. A first cooperating fastener material 14, such as Velcro®, is attached to an inner surface of the attachment end 15. An elastic web segment 16 is interposed between the attachment end 15 and an attachment point where the elastic web segment 16 is attached to an intermediate portion of the second element 13. The elastic web 16 is extensible so as to retain the accessory item 20 when the attachment end 15 is releasably joined to a second fastener material 12, disposed along a top surface of the second element 13, by cooperative engagement of the Velcro® fasteners 12, 14.

The second element 13 formed as an elongate strap has a proximal end and a distal end that, when joined with the first element 11, form a first strap 1, a second strap 2, and a third strap 3, numbered for convenience in understanding the attachment of the accessory retaining strap 10 to an item, as described below. The second element 13 may be formed with a web material along its length. As indicated the second fastener 12 is disposed along a top surface of the second element 13. A bottom surface of the second element 13 includes a length of the second fastener material 14 at least at the proximal end of the second element 13. The second fastener material 14 may extend along a length of the bottom surface of the second element 13. An intermediate portion of the bottom surface of the second element 13, may also include a fabric pad 18, or cover, to cover the web material, or second fastener material 14 to prevent shifting and marring a surface of the firearm carrier 20 or the firearm to which it is attached. The bottouter face is configured to cooperatively engage with a fastener material disposed on an inner face of the first strap.

The distal end may be provided with a trimmable length, wherein the cooperating fastener 12, 14 is stitched to the elongate strap with a plurality of lateral stitches 30 defined in a spaced apart relation along a longitudinal length of the distal end. The user may trim the length of the distal end by cutting across the strap at a point distal to a selected one of the plurality of lateral stitches 30.

In use, the second strap 2 and third strap 3 are wrapped around the item to which the accessory retaining strap 10 is to be secured, such as pistol holster 20. The second strap 2 and the third strap 3 are wrapped around the item in a partially overlapping orientation, such that the first fastener material 12, and the second fastener material 14 may be cooperatively joined to hug the pistol holster 20 from front to back. This cooperative engagement of the second strap 2 and the third strap 3 may also tighten the grip on the holster itself without using any screws or bolts to keep the strap from falling off the holster.

The attachment end 15 of first strap 1 may then be secured with the second fastener material 14 on the inner face joined with the first fastener material 12 on the top surface of the second element 13. To retain an item 20, the first strap 1 may be released from the second element 13. The accessory item 22 may then be placed on the top surface of the second element 13 and positioned proximal to the attachment point of the elastic web 16 with the second element 13. The first strap 1 may then be carried over the accessory item 22 and the attachment end 15 secured with the first fastener material 12 The elastic web segment 16 provides flexibility to the first strap 1 which allows variously sized accessory items, such as a folded tourniquet 22, to be held tightly into place with the firearm 20, or firearm carrier 20.

As will be appreciated from the foregoing, the accessory retention strap 10 of the present invention provides the ability to retain a variety of accessory items 22, a pistol holster 22, or other item, without modification to the manufacture original design and parts.

Placing the accessory retaining strap 10 around a pistol holster 20 allows the user an option free up space on their tactical belt or other part of their uniform and allows easy access to that item 22 within an arm's length reach. In another application of the accessory retaining strap 10, the second strap 2 and third strap 3 may be secured about a stock or body of a long gun, such as a rifle or a shotgun. The first strap 1 may then be utilized to secure a sling against the body of the long gun so that is conveniently out of the way. The first strap 1 may then be released when the user is in need of utilizing the sling. Likewise, the second strap 2 and third strap 3 may be secured around a butt of a long gun, and the first strap 1 may be utilized to secure additional rounds to the long gun.

It should be understood, of course, that the foregoing relates to exemplary embodiments of the invention and that modifications may be made without departing from the spirit and scope of the invention as set forth in the following claims.

What is claimed is:

1. A retaining strap for securing an accessory item to a firearm, comprising:

a first element formed as a strap having an inner surface, an outer surface, and an attachment end, the first element having a length dimensioned to retain the accessory item with the retaining strap;

a second element formed as an elongate strap having a proximal end, a distal end, a top surface, and a bottom surface, the second element having a length dimensioned to extend around at least one of a portion of a firearm, or a carrier for the firearm;

a first cooperating fastener material and a second cooperating fastener material configured for releasable engagement; the first cooperating fastener material covering the inner surface of the attachment end and at least a portion of the bottom surface of the second element, the second cooperating fastener material covering the top surface of the second element from the proximal end to the distal end thereof, and an elastic web interconnecting the first element at an attachment point located at an intermediate position of the top surface of the second element.

2. The retaining strap of claim 1, further comprising:

a fabric pad covering an intermediate portion of the bottom surface of the second element.

3. The retaining strap of claim 1, wherein the first cooperating fastener material covers the bottom surface of the second element from the proximal end to the distal end.

4. The retaining strap of claim 1, further comprising:

a plurality of lateral stitches defined in a spaced apart relation along a longitudinal length of the distal end of the second element.

5. The retaining strap of claim 4, wherein a longitudinal length of the distal end is shortened by cutting distal to a selected one of the plurality of lateral stitches.

6. A method of releasably securing an accessory item to a firearm or a carrier for the firearm, comprising:

providing a retaining strap comprising a first strap having an inner surface, an outer surface, an attachment end, and an elastic web, the first strap having a length dimensioned to retain the accessory item with the retaining strap; an elongate web having a proximal end, a distal end, a top surface and a bottom surface, the elongate web having a length dimensioned to extend around at least one of a portion of the firearm, or the carrier for the firearm, the elastic web attached to the elongate web at an attachment point positioned intermediate portion of the elongate web, to define a second and a third strap from the elongate web at each of the proximal end and the distal end of the elongate web; a first cooperating fastener material and a second cooperating fastener material configured for releasable engagement; the first cooperating fastener material covering the inner surface of the attachment end and at least a portion of the bottom surface of the elongate web, the second cooperating fastener material covering the top surface of the elongate web from the proximal end to the distal end thereof;

wrapping the second strap and third strap about one of the firearm or the carrier for the firearm; and securing the second strap to the third strap by cooperative engagement of the first cooperating fastener material on the bottom surface of the elongate web with the second cooperating fastener material on the top surface of the elongate web.

7. The method of claim 6, further comprising:

placing the accessory item on the top surface of the elongate web proximal to the attachment point;

covering the accessory item with the first strap; and securing the first cooperating fastener material covering the inner surface of the attachment end by cooperative engagement with the second cooperating fastener material covering the top surface of elongate web.

8. The method of claim 7, further comprising:

releasing the first strap from engagement with the retaining strap.

9. The method of claim 8, further comprising:

retrieving the accessory item.

10. The method of claim 6 further comprising:

securing the first strap from cooperative engagement with the second cooperating fastener material covering the top surface of the elongate web.

11. The method of claim 6, the method further comprising:

selecting a tourniquet as the accessory item; and folding the tourniquet for retention by the first strap.

* * * * *